US005463875A

United States Patent [19]

Shavit

[11] Patent Number: 5,463,875

[45] Date of Patent: Nov. 7, 1995

[54] DEFROST CONTROL SYSTEM

[75] Inventor: Jacob Shavit, Ramat Gan, Israel

[73] Assignee: Control & Regulation Circuits Meitav Ltd., Le-Tzion, Israel

[21] Appl. No.: 267,909

[22] Filed: Jul. 6, 1994

[30] Foreign Application Priority Data

Apr. 11, 1994 [IL] Israel ..... 109278

[51] Int. Cl.[6] ..... F25D 21/06

[52] U.S. Cl. ..... 62/140; 62/156

[58] Field of Search ..... 62/151, 156, 140, 62/128, 139; 340/581, 580

[56] References Cited

U.S. PATENT DOCUMENTS

| | | | |
|---|---|---|---|
| 3,039,278 | 6/1962 | Thompson | 62/140 |
| 3,220,208 | 11/1965 | Oram et al. | 62/140 |
| 3,250,083 | 5/1966 | Orth | 62/140 X |
| 3,362,183 | 1/1968 | Sutton, Jr. | 62/140 |
| 3,383,877 | 5/1968 | Liebermann et al. | 62/140 |
| 3,872,683 | 3/1975 | Blanton | 62/140 |
| 4,191,026 | 3/1980 | Sisk . | |
| 4,248,052 | 2/1981 | Bechtel | 62/140 |
| 5,345,775 | 9/1994 | Ridenour | 62/140 |

FOREIGN PATENT DOCUMENTS 2721521 11/1978 Germany .

*Primary Examiner*—Harry B. Tanner

*Attorney, Agent, or Firm*—Wigman, Cohen, Leitner & Myers

[57] ABSTRACT

A defrost control system for use in domestic and/or industrial refrigerators. The system prevents formation of frost due to moisture of the air flow circulating over the evaporation cooling coil of the refrigerator. Frost formation is prevented by virue of heating thereof upon control signal, generated by a sensing means, capable to detect the presence or absence of air flow. The system is provided with an aperture means, capable to pass air flow therethrough in a normal condition and to be blocked by frost, accumulating therein. In the last case the sensing means detects absence of air flow and initiates heating.

4 Claims, 3 Drawing Sheets

DEFROST CONTROL SYSTEM

FIELD OF THE INVENTION

The present invention relates to the field of domestic and industrial refrigeration, namely to refrigerators, in which frost formation takes place due to moisture of the air circulating over the evaporator cooling coil.

More particularly the present invention refers to so-called frost-free refrigerators, in which the frost, appearing as several layers of ice, which accumulates during the cooling process is periodically thawed out to maintain cooling efficiency.

BACKGROUND OF THE INVENTION

The ability to refrigerate, or cool matter, has become not only a necessity but a highly valued luxury in modern culture.

The process of refrigeration is used in a wide variety of domestic and industrial applications. Refrigeration is considered today to be the most valuable method of protecting foods from spoilage, and is used to cool air in air conditioning systems, to produce ice for cooling drinks, and to provide a means for recreation, e.g. ice skating, artificial snow, etc. Without doubt, the ability to refrigerate efficiently is of great value in today's world.

Most contemporary refrigeration systems work in the same fashion. A refrigerant vapor, usually freon, is compressed by a compressor into a liquid in the condenser. The liquid refrigerant is then passed through a flow control device to an evaporator or cooling coil, in which a reduction in the pressure accompanied by vaporization occurs. Refrigeration results from the absorption of heat during vaporization in the cooling coils. The vaporized refrigerant is then drawn back into the compressor and the cycle is repeated.

If the refrigeration system is being used to cool air within a closed environment such as a freezer, cooling cabinet, or cool room, the air is circulated over the evaporator cooling coils by a fan. As the air passes over the evaporator coils, the heat in the air is absorbed by the coils by virtue of the refrigerant inside, thus rendering the air cold.

During the vaporization phase, ice forms on the surface of the evaporator coils due to inevitable moisture present in the air. Once ice forms on the coils, less heat is available to the surface of the coils, for absorption by the refrigerant.

The less heat available for absorption on the surface of the coils, the less efficiently the vaporization process works, and hence, the system.

Removal of the ice which forms as a natural result of the refrigeration process, is critical to the efficient operation of such a system.

Most refrigeration systems solve the problem of ice formation on the cooling coils by incorporating a heating means in close proximity to the coils. The heating means is operated for a few minutes, periodically, and melts the formed ice. Since most of the defrosting devices used until now were non-adaptive, i.e. do not base initiation and termination of the heating means on actual environmental information associated with the presence or absence of ice, more problems arose.

Most current, non-frost refrigeration systems use a time-based defrosting mechanism, known as a defrost timer. This mechanism consists of a small timing device which energizes the heating means, in a cyclic fashion, based on fixed time intervals. Refrigeration manufacturers, usually define this time interval to be most optimal for their particular unit under worst-case conditions. As a result, since most common refrigerators are not exposed to worst-case conditions, the time interval set in the defrost timer is unnecessarily too short. By having too short a time interval, the defrost cycle is instigated often, and wastes energy.

Today, when energy efficiency has become important, and better methods of regulating energy consumption have become critical, such defrost control systems, employing timers are becoming obsolete.

As a result, several solutions have been realized to meet energy efficiency requirements.

One example of a defrost control system is disclosed in German patent DE2721521. This device is provided with a main air conveying channel and an auxiliary bypass channel.

There is a heat register in front of the refrigeration system for heating a cross-section of the air flow at an even rate. When the cooling coils are free of ice, the air passes smoothly through the coils. Since the heat register maintains a constant temperature, the amount of energy required to maintain that temperature is measurable. In the event of icing on the cooling coils, the free passage of air over and through the coils is interrupted. Since the heat register is not being cooled by the flow of the air through the coils, which is obstructed by the icing of the coils, the register requires less energy to maintain its fixed temperature. The reduction in the amount of energy required to heat the register up to its set temperature indicates a build up of ice on the cooling coils, and the defrosting cycle is initiated.

The disadvantage of this system is associated with its low sensitivity. This system does not initiate the defrosting action directly upon detection of ice, per se', but rather "waits" until the flow of air over and through entire area, occupied by the cooling coils, is sufficiently impeded due to the appearance of ice.

In another example of a defrosting system, described in U.S. Pat. No. 4,191,026, the defrost cycle is initiated by sensing the pressure drop across a heat exchanger. This method is implemented by installing a small diameter pipe within a wall of the duct, downstream of the heat exchanger so that during normal operation, an air current is drawn through the pipe. The pipe's interior is constantly heated so that the temperature of the heated current remains constant as long as the air volume flowing through the pipe remains constant.

As the pressure drop across the heat exchanger increases, as a result of frost buildup, relatively more air is drawn through the pipe and the temperature of the heated air in the pipe decreases, resulting in the generation of an appropriate signal to initiate the defrost cycle.

As can be readily appreciated, the disadvantages of this system are similar to those described above, in that it is not capable of detecting ice itself and initiate the defrosting action thereupon.

Besides low sensitivity inevitably associated with the monitoring of such effects, like pressure drops, flow rate variations, etc. induced by frost formation which covers the entire surface of an evaporator coil, the known systems are not pre-selective in the sense that they do not allow initiation of a defrosting cycle based on the appearance of frost in a particular location of the coil.

Further, the above defrost control systems require the establishment of a steady-state environment within the refrigerator to work efficiently. They might be unreliable in domestic applications where the aerodynamic characteristics within the cooling chamber's environment change often, e.g. due to the opening of a freezer door.

It should be pointed out that the known defrost control systems usually consist of a large number of components. These systems are bulky, require additional space within the refrigerator, and can not be retrofitted without significant alterations to existing refrigeration units.

OBJECT OF THE INVENTION

The object of the present invention is to provide a defrost control system in which the above mentioned drawbacks of the known defrost control systems are significantly reduced or overcome.

In particular the main object of the invention is to provide a simple, reliable, cost-effective and energy saving defrost control system, capable of initiating and terminating a defrost cycle with high sensitivity, upon local appearance of ice on the evaporator coils.

The second object of the present invention is to provide a defrost control system, which can be easily attached directly to the evaporator coils, at any given location, and may be incorporated into existing refrigerators, without the need of major alterations.

The third object of the present invention is to provide a defrost control system, whose functioning is relatively unaffected by changes in the refrigerator's interior environment, such as the opening of a refrigerator door.

The above and other objects and advantages of the present invention can be achieved in accordance with the following combination of essential features:

A defrost control system for use in domestic and/or industrial refrigerators, in which the circulation of air, which passes over evaporator cooling coils, might result in the formation of frost within a freezer compartment and/or a cooling cabinet. Said system comprising of:

An aperture means, formed as a tubular member, provided with a through going opening, extending there along and defined by an inlet and outlet aperture. Said opening being capable of passing said air flow through said outlet aperture in a normal condition, corresponding to the absence of frost therein and being capable of being blocked by frost, accumulating therein so as to restrict the emergence of air through said outlet aperture, whereas disposition of said aperture means with respect to said coil is chosen so as to ensure accumulation of frost within said through going opening simultaneously with the appearance of frost on said cooling coil, a sensing means, mounted preferably in proximity of said outlet aperture and being capable to detect the presence or absence of air flow to emerge therethrough and to generate appropriate signals thereupon, a control means, adapted to receive said signals and to transfer them to, a heating means, adapted to be energized or de-energized by said control means so as to initiate or terminate the thawing out of said frost.

In accord with one of the preferred embodiments, said aperture means is releasable mounted on the surface of said cooling coil and at least part of said through going opening is arranged so as to be in direct communication with the surface of said coil.

In another preferred embodiment, the defrost control system in accord with the present invention might be provided with an auxiliary tubular member, defined by proximal and distal extremities, whereas the proximal extremity thereof is located so as to communicate with the outlet aperture of said aperture means and the distal extremity thereof is located in vicinity of said air circulating means so as to assist the air flow passing through said aperture means.

According to still another preferred embodiment, said sensing means is formed as a thermistor, situated within said auxiliary tubular member.

In other preferred embodiment, said flow restricting means is formed of material, having a low thermal conductivity for example: plastic.

In still another preferred embodiment, the cross-sectional configuration of that part of said opening, which is arranged so as to be in direct communication with the surface of said coil is defined by a first dimension, directed substantially outwardly from the surface of said coil and by a second dimension, directed along the surface of said coil.

The present invention in its various embodiments has only been summarized briefly.

For a better understanding of the present invention as well as of its advantages, reference will now be made to the following description of its above listed embodiments, taken together with the accompanying drawings.

DETAILED DESCRIPTION OF SPECIFIC EMBODIMENTS

Figure 2:
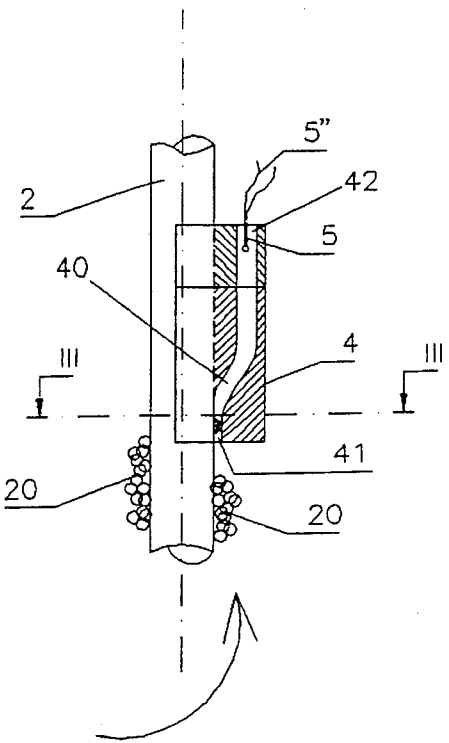
FIG. 2 Is an enlarged, partially cross-sectioned view of detail II, shown in FIG. 1.
Figure 1:
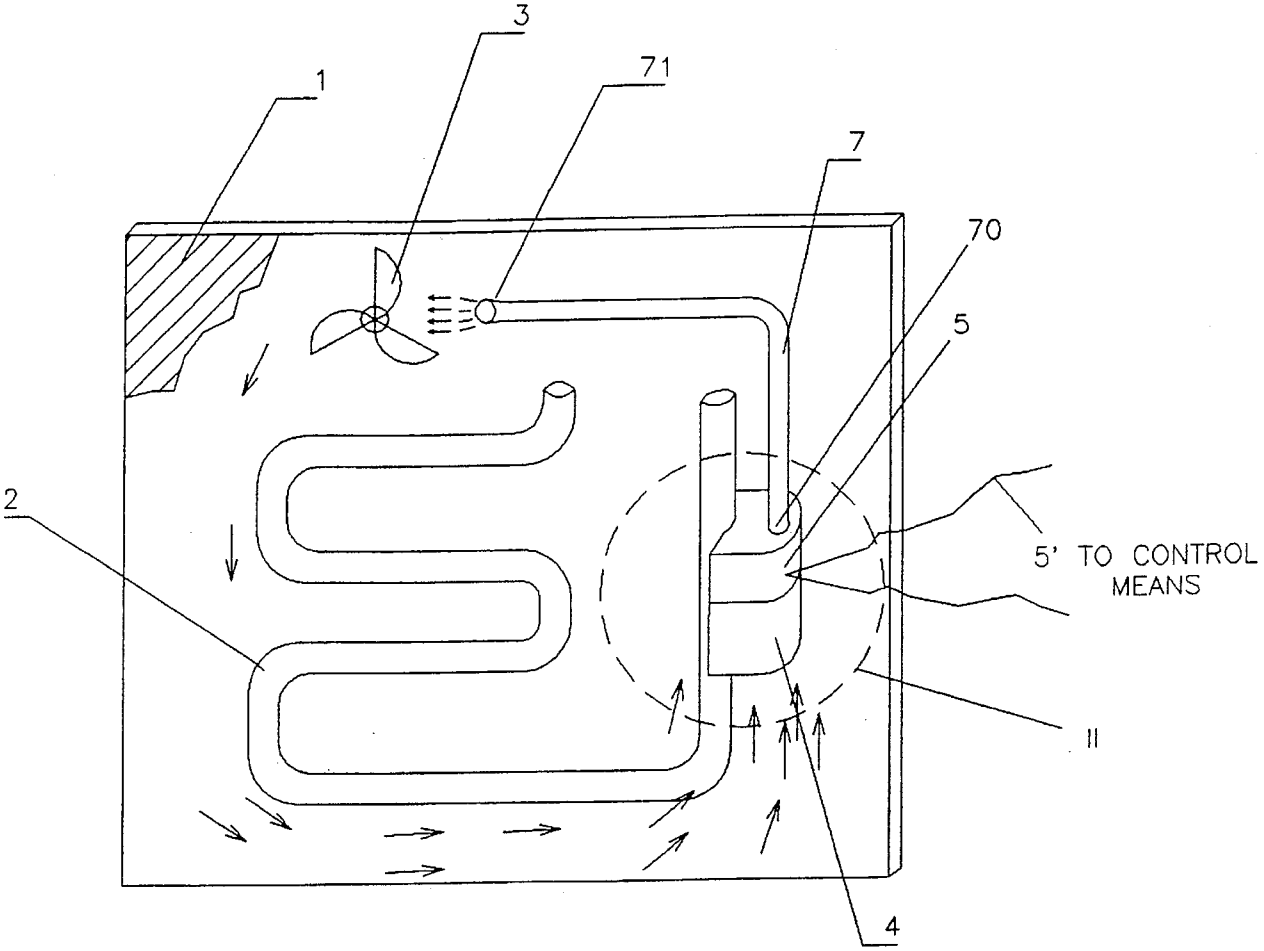
FIG. 1 Shows schematically the defrost control system according to the present invention, installed within a domestic refrigerator.

With reference to FIG. 1, wall [1 ], of a domestic refrigerator, which includes a single-coil evaporator [2], mounted in a vertical position thereon, for example, in a freezer compartment to cool air, which is circulated therein by means of small fan [3]. A heating means is provided (not shown) to heat the coil and melt the ice, which periodically crystallizes thereon due to moisture in the freezer environment.

The heating means is capable of being energized or de-energized by the defrost control system, which will be described now in more detail.

The main component of the system is an aperture means [4], formed as a small elongated tubular member, provided with a through going opening [40], which extends there along and is defined by an inlet aperture [41]and an outlet aperture [42]. This tubular member is positioned within the freezer compartment in such a manner that the air flow can enter therein through the inlet aperture [41], pass therethrough via opening [40]and emerge therefrom via outlet aperture [42]. Sensing means [5]is provided and is adapted to detect the presence or absence of air flow, emerging from outlet aperture [42]and to generate an appropriate signal, which is transferred via wiring [5']to control system [50], being set to trigger the heating means thereupon.

In accordance with the present invention it is particularly advantageous if the aperture means [4]is attached to the coil or any other surface prone to icing so as to ensure good thermal contact therebetween and to establish conditions for simultaneous frost appearance both on the coil surface and within the aperture means. Formation of frost within the through-going opening [40], restricts the flow of air from passing therethrough until the opening will be completely blocked and no air will flow through the outlet aperture [42].

Auxiliary tubular element [7]can be provided, defined by a proximal extremity [70], communicating with outlet aperture [42]and by a distal extremity [71], situated behind the fan, so as to cause a suction, assisting the air flow, passing through the aperture means [4].

With reference to FIGS. 3–6, the construction of aperture means [4], advantageously ensuring the above mentioned conditions for simultaneous frost formation will now be explained.

Aperture means [4]is formed as an elongated member, provided with a concave opened recess [43], extending there along and having a cross-sectional configuration, with a radius of curvature "R" substantially matching that of the outside surface of the coil [2], so as to provide a reliable contact therebetween once the member is attached thereto.

As can be readily appreciated, this arrangement enables easy attachment of the aperture means directly to the coil at any given location on all existing and newly manufactured refrigeration units.

Securing the aperture means to the coil can be ensured by providing an aperture member with springing bendable shoulders [43'], [43"], formed on the open side of recess [43]and capable of being moved aside so as to enable a reliable grasping of the coil when the member is attached and to snap around it afterwards.

It should be understood that a separate attachment means for the mounting of the aperture means can be implemented as well, for example bands, clamping screws, etc.

Figure 3:
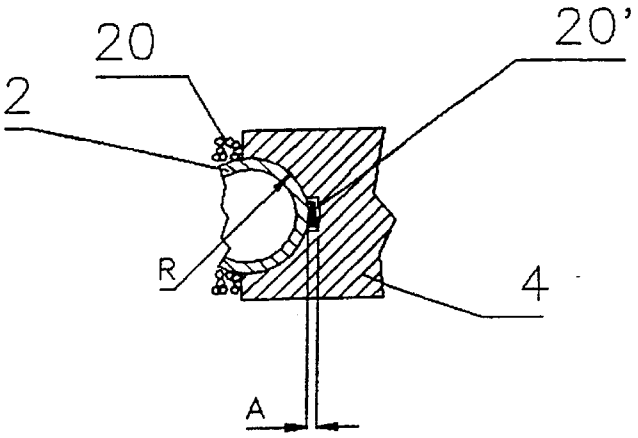
FIG. 3 Is an enlarged cross-section 111—111 of FIG. 2.
Figure 6:
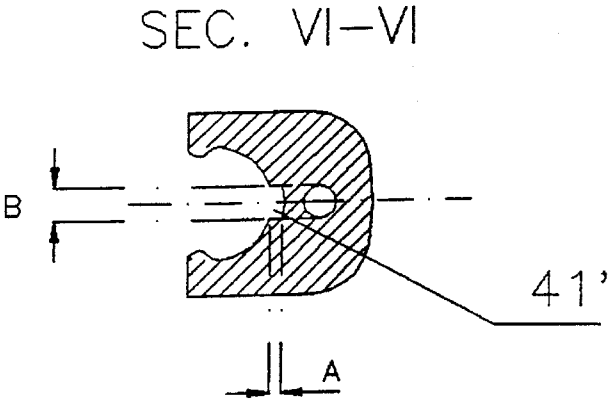
FIGS. 4,5,6 Presents, longitudinal and two-transversal cross-sections of the aperture means, employed in the defrost control system according to the present invention.
Figure 4:
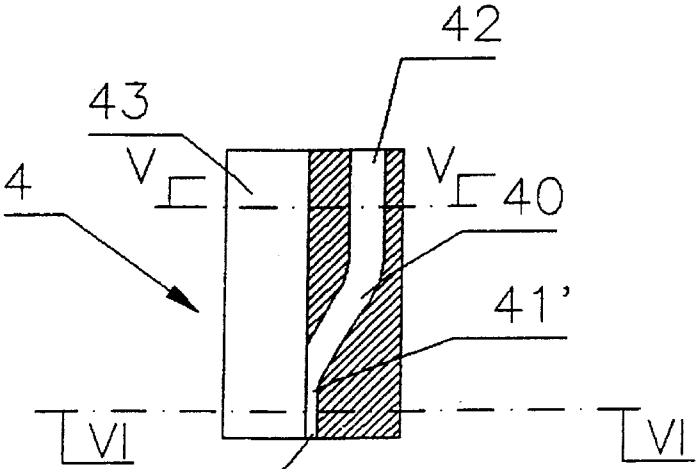
Figure 5:
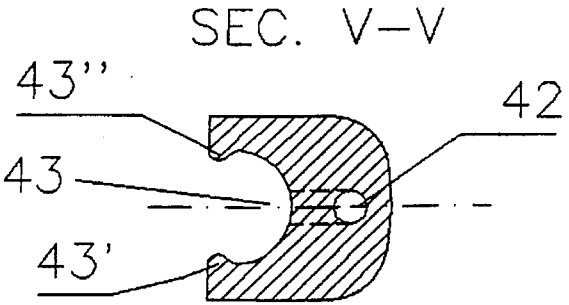

At least part of the through going opening [40], extending via the aperture means comprises of a relatively short portion [41'], which initiates at the inlet aperture [41]and merges directly with the concave recess [43]. With reference to FIG. 3 it can be easily seen that when aperture means [4]is mounted on the coil, the cross-section of the through going opening, corresponding to portion [41']is partially defined by the outside surface of coil [2]. Since the interior of the through going opening, corresponding to portion [41'], communicates with the coil surface, it is in direct contact with the coil. By virtue of this provision, there is ensured that the ice [20'], appearing on the coil will block this opening until no air can flow and emerge from outlet aperture [42]. This situation will be detected by the sensing means [5], and an appropriate signal will be immediately generated thereupon and transferred to the control means [50], which will energize the heating means.

It has been empirically found, that the most reliable performances of defrost control system according to tile present invention in terms of sensitivity and immediate response upon the blocking of the through going opening due to the appearance of ice can be achieved if a cross-section of portion [41'], communicating with the coil surface, has an approximately rectangular configuration, defined by a first dimension [A], extending outwardly from the coil and by a second dimension [B], directed along the coil.

In practice these dimensions are chosen with respect to the manufacturer's requirements, regarding their optimal defrost cycle.

In order to achieve the most suitable conditions for the appearance of ice within the opening simultaneously with the formation of ice at other locations on the coil, it may be advantageous .if the aperture means is made of a material, having thermal conductivity significantly lower than that of the coil.

In practice, the aperture means is made of a plastic material, having sufficient resiliency at temperatures within refrigerators so as to enable a springing action of the shoulders [43'], [43"]and reliable securing of the aperture means on the coil [2].

Aperture means [4], described above is formed as a separate member, attachable to the coil. It should be understood that this aperture means can be arranged also integrally with the coil.

The sensing means, utilized in the defrost control system, according to the present invention, employs a thermistor. However any other conventional sensors, capable of detecting the presence and/or absence of an air flow and to generate an appropriate signal accordingly, like anemometers, thermal-type flow meters, etc. can also be employed. In practice, it is recommended to locate the thermistor within the auxiliary tubular member in such a manner that the working head thereof is situated in proximity of the outlet aperture without touching the inner surface of the auxiliary tubular member.

Figure 7:
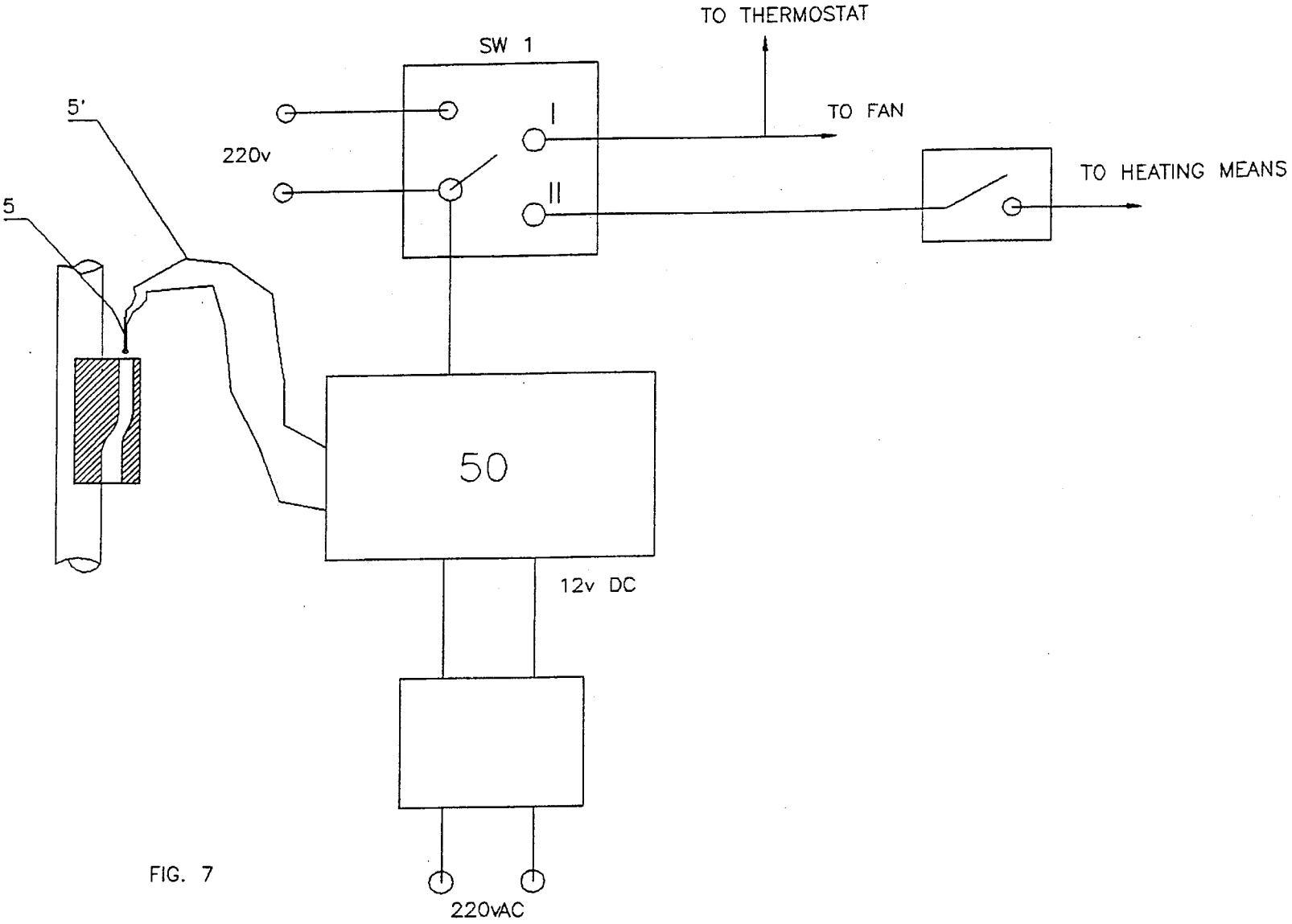
FIG. 7 Shows schematically how the sensing means and aperture means are configured with the control means in the defrost control system according to the present invention.

With reference to FIG. 7, the control means employed in the present invention is adapted to energize or de-energize a heating means (not shown) by switch SW1, after it is brought into position II or 1 by main block [50], upon receiving an appropriate signal from sensing means [5].

It should be understood that the main block [50]can be arranged so as to be programmable and compatible with other systems, which might be present in modern refrigeration equipment.

The defrost control system, according to the present invention, is very simple, consists of a very limited amount of components, and has been found to function reliably irrespective of any changes in the refrigerator's interior environment, such as the opening of a door and the like.

The present invention should not be limited to the above described embodiments and it should be realized, that changes and modifications can be made by one ordinarily skilled in the art, without deviation from the scope of the invention, as it will be defined below in the appended claims.

I claim:

1. A defrost control system for use in refrigeration apparatus in which circulation of air over an evaporator cooling coil can result in frost formation thereon, comprising:

an aperture means formed as a tubular member having a recess within said tubular member so as to be in direct communication with an outside surface of said coil, provided with an opening therethrough extending along and defined by an inlet and outlet aperture thereof, said opening being capable of passing said air flow therethrough so as to enable the emergence of air from the outlet aperture thereof in a first, normal condition corresponding to an absence of frost therein and being capable of becoming blocked by the presence of frost accumulating therein in a second condition so as to restrict the emergence of air from said outlet aperture;

a sensing means mounted in proximity to said outlet aperture and being capable of detecting the presence or absence of airflow therethrough and of generating signals related to such presence or absence of frost;

a control element capable of receiving said signals and of translating them; and a heating means adapted to be energized or de-energized by said control element so as to initiate the thawing of said frost when energized;

wherein said tubular member is located on an outside surface of said coil in such a manner that the direction of said opening coincides with the direction of movement of said circulating air circulating over said evaporator coil in said normal condition, corresponding to absence of frost, whereas at least part of said tubular member has a thermal conductivity characteristic which is lower than that of the coil so as to enable accumulation of frost within said opening substantially simultaneously with the appearance of frost on the outside surface of said coil.

2. The defrost control system of claim 1, wherein said tubular member is made of a plastic material and is releasably attached to the outside surface of said coil and said sensing mens is located within said opening.

3. The defrost control system of claim 2, wherein said recess is defined by a rectangular cross-section having a first dimension extending outwardly from the coil surface, and by a second dimension extending along the coil surface.

4. The defrost control system of claim 3, wherein said sensing means is formed as a thermistor situated within said auxiliary tubular member.

* * * * *